US005324224A

United States Patent [19]

Anderson et al.

[11] Patent Number: 5,324,224

[45] Date of Patent: Jun. 28, 1994

[54] SPHERICAL CONSTRUCTION TOY AND LIGHT APPARATUS

[76] Inventors: Richard H. Anderson, 428 W. 6th St., Tustin, Calif. 92680; Robert R. Anderson; Richard R. Anderson, both of P.O. Box 1059, Trabuco Canyon, Calif. 92678

[21] Appl. No.: 95,081

[22] Filed: Jul. 20, 1993

Related U.S. Application Data

[63] Continuation of Ser. No. 804,795, Dec. 9, 1991, abandoned.

[51] Int. Cl.[5] ..... A63H 33/26; A63H 33/04; A63H 33/22; A63H 1/24

[52] U.S. Cl. ..... 446/91; 446/219; 446/236; 446/242; 446/485; 434/286; 434/96; 362/32; 362/184; 362/186; 362/277; 362/809; 40/452; 40/579

[58] Field of Search ..... 446/90, 91, 219, 236, 446/242, 256, 485; 362/32, 184, 186, 252, 277, 363, 806, 808, 809; 434/286, 96, 98, 87, 92, 106; 40/431, 452, 473, 579

[56] References Cited

U.S. PATENT DOCUMENTS

| | | | |
|---|---|---|---|
| 1,845,530 | 2/1932 | Tarallo | 40/452 X |
| 1,957,763 | 5/1934 | Dupler | 362/802 X |
| 2,149,363 | 3/1939 | Rivkin . | |
| 2,434,250 | 1/1948 | Rebus . | |
| 2,629,044 | 2/1953 | MarFisi | 40/431 |
| 3,049,813 | 8/1962 | List . | |
| 3,348,321 | 10/1967 | Cunningham . | |
| 3,530,615 | 9/1970 | Meyer | 446/91 |
| 3,568,357 | 3/1971 | Lebensfeld | 446/91 |
| 3,589,056 | 6/1971 | Glass et al. . | |
| 3,634,678 | 1/1972 | Glass | 446/91 X |
| 3,780,695 | 12/1973 | Richard . | |
| 4,196,539 | 4/1980 | Speers . | |
| 4,276,705 | 7/1981 | Barth et al. . | |
| 4,403,964 | 9/1983 | Meier | 434/286 |
| 4,541,812 | 9/1985 | Katsumata . | |
| 4,891,030 | 1/1990 | Gertzfeld . | |
| 5,035,623 | 7/1991 | Ceudurier et al. | 434/886 |
| 5,038,482 | 8/1991 | Anderson et al. . | |
| 5,084,803 | 1/1992 | Lan | 446/485 X |
| 5,091,833 | 2/1992 | Pancagas et al. | 446/485 X |

FOREIGN PATENT DOCUMENTS

| | | | |
|---|---|---|---|
| 734659 | 5/1966 | Canada . | |
| 2843172 | 8/1979 | Fed. Rep. of Germany | 446/219 |
| 1538008 | 7/1968 | France . | |
| 2221626 | 2/1990 | United Kingdom | 446/219 |

*Primary Examiner*—David N. Muir
*Attorney, Agent, or Firm*—Stetina and Brunda

[57] ABSTRACT

The present invention comprises a hollow globe including a plurality of apertures which are formed substantially throughout the entire surface of the globe. Formed within the globe and disposed in laminar juxtaposition to the interior surface of the globe's sphere, a bladder means is formed of an opaque flexible material. A plurality of cross slits are formed on the bladder in substantial alignment with the globe's surface. An internal light source is disposed within said bladder at approximately the midpoint of the globe's sphere, and a plurality of luminescent pegs are provided for insertion into the apertures formed in the globe's surface. The present invention provides the user with the plurality of luminescent, differently colored pegs to design a picture or art form. The present invention may additionally serve as a night light and the luminescent pegs may be specially adapted to project light from the interior of the globe's surface to the exterior of the globe and onto surrounding walls and ceilings. The globe may additionally be rotatable around the axis by a rotating mechanism which is controlled by an on/off switch.

14 Claims, 2 Drawing Sheets

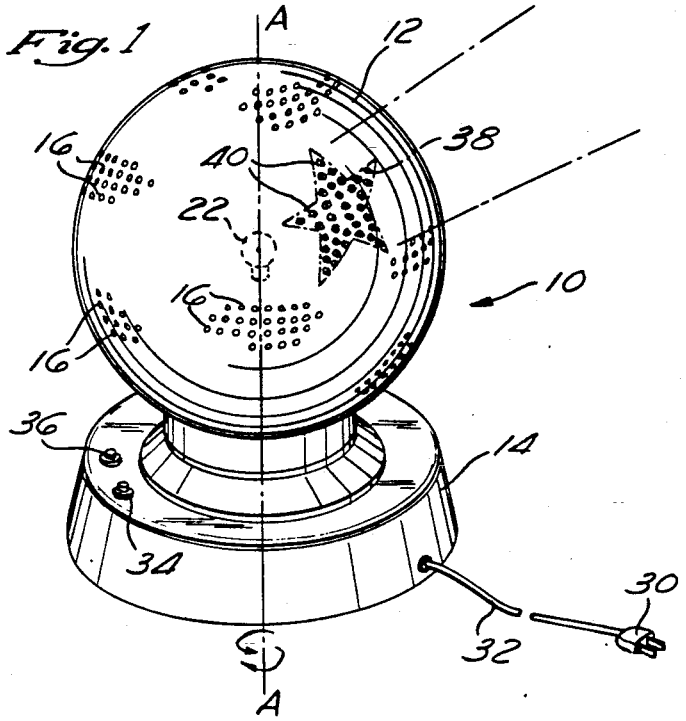
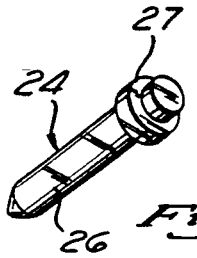
Fig. 2
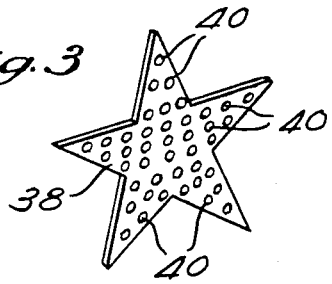
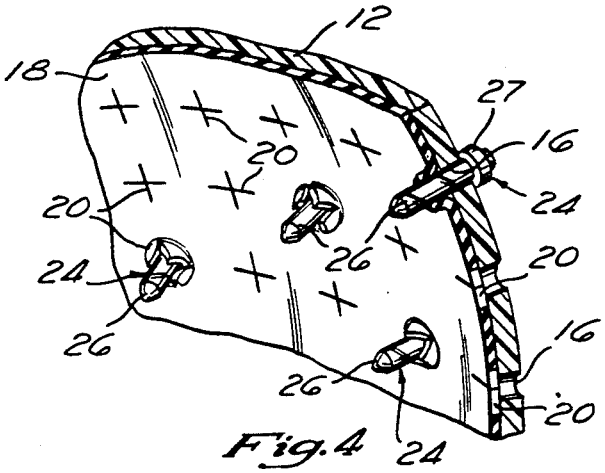
Fig. 4
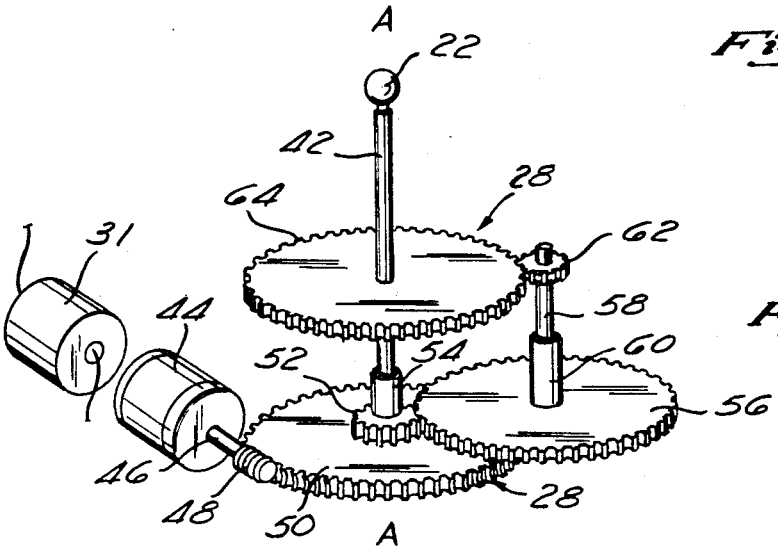
Fig. 5

SPHERICAL CONSTRUCTION TOY AND LIGHT APPARATUS

This application is a continuation of application Ser. No. 07/804,795, filed Dec. 9, 1991, now abandoned.

FIELD OF THE INVENTION

The present invention relates generally to a spherical construction toy device and light apparatus. More particularly, the present invention comprises an upper sphere and lower base portion wherein the outer surface of the sphere portion includes a plurality of apertures formed substantially throughout the surface and a plurality of light pegs are provided for insertion into said plurality of apertures. Insertion of the luminescent pegs allows the formation of a variety of patterns on the surface of said sphere to provide amusement, as well a source of light, to the user.

BACKGROUND OF THE INVENTION

Toy or game devices which include a flat apertured surface for receiving a plurality of light transmitting pegs are well known. Normally, in such applications, the flat apertured surface is positioned over an enclosed housing which includes an internal light source. Light transmitting pegs are included for insertion into the provided apertures allowing the shank insert portion of the pegs to be exposed to the internal light source. Light is received by the exposed shank and transmitted to an enlarged head portion of the peg and the colors of the pegs are enhanced. The user can assemble the light transmitting pegs into various patterns using the plurality of colors. One such construction toy utilizing the aforementioned components is presently manufactured and marketed by Hasbro Industries, Inc. and is sold under the trademark LITE-BRITE (LITE-BRITE is a trademark of Hasbro Industries, Inc.).

While the LITE-BRITE toy from Hasbro Industries, Inc. and other prior art devices have met with great success over the years, it would be desirable to use the light transmitting peg and pegboard concept in association with a globe or spherical device. Additionally, it would be desirable to increase the pegboard surface area.

It would also be desirable to utilize a light transmitting peg and pegboard design in a movable, rotating mode to give a motion effect to the peg design. The prior art devices are stationary and provides no other amusement to the user than constructing and then viewing a pattern that the user has created.

The prior art devices also have the disadvantage of requiring the use of a sheet of opaque material to be inserted between the apertured pegboard and the light source to prevent light escaping from apertures which are not being utilized. Thus, it would be desirable to have a pegboard including light transmissive pegs which would not require insertion of a sheet of opaque paper beneath the pegboard surface.

SUMMARY OF THE INVENTION

The present invention specifically addresses and alleviates the above-mentioned deficiencies in association with the prior art to provide a more amusing and functional luminescent pegboard device. More particularly, the present invention comprises a spherical globe which includes a plurality of apertures and corresponding luminescent pegs which are inserted into said apertures to form various patterns as desired by the user.

In a first embodiment, the present invention comprises a hollow globe including a plurality of apertures which are formed substantially throughout the entire surface of the globe. Formed within the globe, and disposed in laminar juxtaposition to the interior surface of the globe's sphere, a bladder means is formed of an opaque flexible material. A plurality of cross-slits are formed on the bladder in substantial alignment with the apertures of the globe surface. An internal light source is disposed within said bladder at approximately the midpoint of the globe sphere. A plurality of light transmissive pegs are provided for insertion into the apertures formed in the globe surface.

Each of the plurality of light transmissive pegs includes a first and second end, wherein the first end of a light transmissive peg is comprised of an elongate shank of sufficient minimal diameter to fit within the apertures of the globe surface and of a sufficient length to penetrate the cross-slits formed within the bladder, thereby exposing at least a small portion of the shank to the light source. The second end of said light transmissive peg includes an enlarged head portion of a sufficient diameter to prevent the head portion of said light transmissive peg from passing through the apertures formed within the globe surface. The light transmissive pegs therefore effectively transmit light from the interior of the surface of the globe to the exterior to give the effect of illumination of the light transmissive peg and enlarged head portion.

The first embodiment of the present invention also includes a means for rotating said globe about an axis wherein said axes of rotation is generally vertical and passes substantially through the center point of the globe's sphere. The means for rotation of the globe sphere is accomplished through the use of a small electric motor device which engages a series of reduction gears to provide low velocity rotational movement of the sphere. The electric motor and a plurality of reduction gears comprising the rotation means is located within a housing which forms the base of the globe sphere. The first embodiment of the present invention additionally includes a switch means for controlling the means for rotating said globe, as well as a switch means for controlling the internal light source.

The intersection of the longitudinal axes of the pegs, when inserted into the apertures, define a focus of the pegs. That is, all of the longitudinal axes of the pegs run through the center of the sphere, thereby forming a focus. The internal light source is disposed at the focus of the pegs so as to enhance light transmission through the pegs. Thus, a substantially portion of the light radiated from the internal light source is inherently radiated along the longitudinal axis of each peg, thereby enhancing light transmission through each peg.

A second embodiment of the present invention includes all of the components as described in the first embodiment of the present invention but further includes a peg template which includes an apertured figure member which is specifically configured to be disposed in laminar juxtaposition to the outer surface of the globe sphere. The peg template is designed and includes a plurality of apertures formed therein wherein the plurality of apertures of the peg template are positioned to be in substantial alignment with the apertures formed in said globe when the peg template is disposed upon the outer surface of the globe sphere. The peg template provides a pre-designed pattern which a user of the present invention may dispose the pegs to form a recognizable pattern. For example, a pre-designed template may include a design of a five-pointed star which the user may utilize as a guide for insertion of the light transmissive pegs to thereby create a lighted star design upon the surface of the globe.

A third embodiment of the present invention may include specially designed light transmissive peg devices which not only provide a light effect, but which also project the light from the interior of the globe onto walls or ceilings of a room in which the rotating globe may be disposed. The effect would be to project points of light which may be arranged to form images upon the walls and ceiling of such room.

BRIEF DESCRIPTION OF THE DRAWINGS

FIG. 1 is an external structural view of the spherical construction toy and light apparatus of the present invention;

FIG. 2 is a luminescent peg adapted for insertion into a respective one of the plurality of apertures in the surface of the spherical construction toy and light apparatus of the present invention;

FIG. 3 is a representation of the peg template of the second embodiment of the present invention;

FIG. 4 is a cutaway view shown from the interior of the sphere of the present invention including light transmissive pegs inserted therein;

FIG. 5 is a representation of the gearing of the rotation means of the present invention.

DETAILED DESCRIPTION OF THE PREFERRED EMBODIMENT

Figure 6:
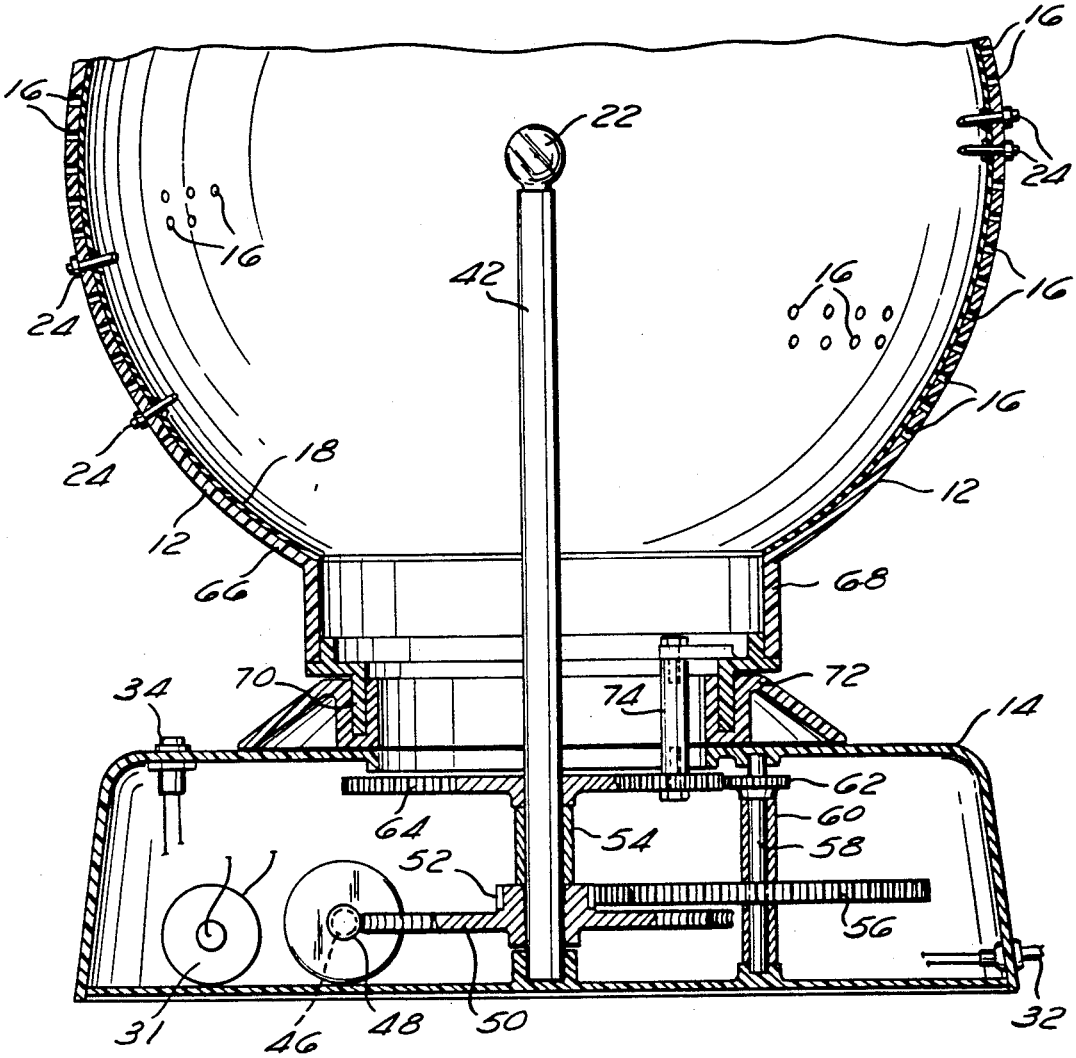
FIG. 6 is a cross-sectional view of the internal structure of the present invention.

The detailed description as set forth below in connection with the appended drawings is intended as a description of the presently preferred embodiments of the invention, and is not intended to represent the only form in which the present invention may be constructed or utilized. The description sets forth the functions and sequence of steps for constructing and operating the invention in connection with the illustrated embodiments. It is understood, however, that the same or equivalent functions and sequences may be accomplished by different embodiments and that they are also intended to be encompassed within the spirit and scope of this invention.

Shown in FIG. 1 is the three-dimensional construction toy and light apparatus 10 of the present invention including a globe portion 12 and a base portion 14. Referring particularly to FIGS. 1 and 6, the three-dimensional construction toy and light apparatus 10 comprises a globe portion 12 of a hollow configuration which includes a plurality of apertures 16 formed substantially throughout the entire surface of the globe portion 12 structure. An inner bladder 18 is disposed within the globe portion 12 in laminar juxtaposition with the inner surface of the globe portion 12. The inner bladder 18 is formed of an opaque flexible material including a plurality of slots and preferably cross slits 20 as shown in FIG. 4, wherein the cross slits 20 are formed in such a manner as to be in substantial alignment with the plurality of apertures 16 formed throughout the surface of the globe portion 12. An internal light source 22 is disposed within the inner bladder 18. It is understood and contemplated by the present invention that while the preferred embodiment includes a sphere or globe, that such sphere or globe may be comprised of any hollow structure or housing of any shape.

A plurality of light transmissive pegs 24 include a shank portion 26 having a diameter sized for insertion into a respective one of the apertures 16. The shank portion 26 is of a sufficient length to penetrate the cross slits 20 of the inner bladder 18. The light transmissive peg 24 also includes an enlarged head portion 27, as shown in FIG. 2, of a diameter greater than the apertures 16.

The three-dimension construction toy and light apparatus 10 of the present invention includes a rotating means 28 about an axis A—A. The rotating means 28 will hereinafter be more fully described as set forth below with reference to FIG. 5 and it is understood and contemplated by the present invention that the rotating means may be comprised of any mechanism suitable for rotating the globe portion 12 about the axis A—A.

The rotating means 28 in the preferred embodiment of the invention is powered by an AC power supply by a conventional outlet plug 30 and power cord 32. It is additionally contemplated and understood by the present invention that the rotating means 28 may additionally be powered by a battery device 31. The rotating means 28 is enclosed within a housing base portion 14 which forms the structural base for the globe portion 12.

The rotating means 28 is controlled by a first switch means 34 which operates the rotating means in the on or off position. It is additionally contemplated by the present invention that the first switch means could include a variable switch device which may vary the angular velocity of the globe portion 12.

The internal light source 22 is positioned at substantially the center point within the globe portion 12 and is additionally controlled by a second switch means 36 controlling the light in either the on or off position. Again, it is contemplated and understood by the present invention that the second switch means may control the intensity of light in a variable manner.

A second embodiment of the construction toy and light apparatus 10 of the present invention includes all of the elements of the first embodiment of the present invention but additionally comprises a peg template 38 which is shown as a star design in FIG. 1 and will hereinafter be more fully described as set forth below with reference to FIG. 3. The peg template 38 is configured to be disposed in laminar juxtaposition with the outer surface of the globe portion 12 and the peg template 38 includes a plurality of apertures 40 formed within the peg template 38 to be positioned substantially in alignment with the globe portion 12 apertures 16 and sized to receive the shank portion 26 of the light transmissive peg 24.

When the shank portion 26 of the light transmissive peg 24 is inserted within the apertures 40 through the cross slits 20 of the inner bladder 18, such shank portion 26 is configured to receive light from the internal light source 22 and direct such light to the enlarged head portion 27 of the light transmissive peg 24 to enhance the color of the peg 24. A third embodiment of the construction toy light apparatus 10 of the present invention includes the light transmissive peg 24 with a specially adapted head portion 27 which projects the light received through the shank portion 26 from the internal light source 22 and projects that light into the space surrounding the globe portion 12. If the space immediately surrounding the globe portion 12 includes walls and ceilings, such as in the confines of an ordinary room, the specially adapted portion 27 projects the light onto the walls and ceiling of such room which creates visual effects, such as a specially adapted pattern as directed by the a peg template 38 or an original design by the user, and which may be enhanced by the rotation of the globe portion 12.

Referring specifically to FIG. 2, there is shown a light transmissive peg 24 having a shank portion 26 and an enlarged head portion 27. As previously described, the shank portion 26 of the light transmissive peg 24 is inserted into the respective one of said apertures of the globe portion 12. While the light transmissive peg 24 is preferably comprised of a rigid plastic material, it is understood and contemplated by the present invention that the light transmissive peg 24 may be comprised of any rigid or semi-rigid material which is capable of transmitting light received at the shank portion 26 to the enlarged head portion 27. The light transmissive pegs 24 may be comprised of a differently colored plastics which would provide the user with a variety of colors to use in constructing designs on the surface of the globe portion 12. Additionally, the light transmissive peg 24 may be specially adapted to include the enlarged head portion 27 which is capable of projecting light received from the internal light source 22 into the shank portion 26 and projecting that light into the area surrounding the globe portion 12. The effect of the projected light could be utilized in a variety of applications including the projection of images created by designs formed by the light transmissive pegs 20 on the surface of the globe portion 12. The effect would be enhanced by the rotation of the globe portion 12 about the A—A axis. The present invention may also be utilized as a night light type of device, either in the rotation mode or otherwise.

Referring specifically to FIG. 3, there is shown a peg template 38 which is comprised of a resilient material which includes a plurality of apertures 40 formed throughout the surface of such template 38 wherein the peg template 38 is specifically configured to be disposed in laminar juxtaposition to the outer surface of the globe portion 12 and the plurality of apertures 40 positioned to be in substantial alignment with the apertures 16 formed in the outer surface of the globe portion 12. The peg template 38 comprises a pre-designed pattern which may be fabricated in a variety of configurations and may guide a user of the present invention to indicate proper insertion of the light transmissive pegs 24 into a recognizable pattern on the surface of the globe portion 12. The peg template 38 may be color-coded to indicate the particular color to be utilized in the pre-designed pattern. Thus, utilizing a light transmissive peg 24 in conjunction with the peg template 38 would necessitate inserting the shank portion 26 of the light transmissive peg through the aperture 40 of the peg template 38 and into the aperture 16 of the globe portion 12, through the inner bladder 18 via the cross slits 20. The shank portion 26 would then receive light from the internal light source 22 and project that light to the enlarged head portion 27.

Referring specifically to FIG. 4, there is shown a cutaway portion respective view of the interior surface of the inner bladder 18 in laminar juxtaposition with the inner surface of the globe portion 12. A plurality of slits or openings and preferably cross slits 20 are formed throughout the surface of the inner bladder 18 to be in substantial alignment with the apertures 16 formed in the surface of the globe 12. The inner bladder 18 is formed of a resilient material which will allow the passage of the shank portion 26 of the light transmissive peg 24 but not allowing excess light to escape to the exterior surface of the globe portion 12. Additionally, when the shank portion 26 of the light transmissive peg 24 is removed from the aperture 16 of the globe portion 12, the resilient material of the inner bladder 18 reforms to its original state and closes the cross slits 20 in such a manner as to not allow light from the internal light source 22 to escape the inner bladder 18. The inner bladder is comprised of an opaque material.

Referring particularly to FIG. 5, there is shown the rotating means 28 of the present invention. The rotating means 28 is designed around a hollow shaft which supports the internal light source 22, and additionally allows wires to be fed through the hollow shaft 42 to provide power to the internal light source 22. A small electric motor 44 provides the necessary kinetics for the motion necessary to rotate the globe portion 12. The motor 44 is interconnected by a rotating horizontal shaft 46 interconnected to a screw gear 48 which translates the rotation of the horizontal shaft 46 to rotation of a first reduction gear 50 about an axis A—A. The first reduction gear 50 is affixed to and substantially abutted against an upper translation gear 52 and the first reduction gear 50 and the translation gear 52 and a sleeve 54 are affixed about the hollow shaft 42. The upper translation gear 52 engages a second reduction gear 56 which is mounted about a vertical shaft 58 and wherein the center portion of the second reduction gear 56 is affixed to a vertical sleeve 60 having a first and second end, said first end the vertical sleeve 60 affixed to the second reduction gear 56 and said second end of the vertical sleeve 60 being affixed to a translation gear 62. The translation gear 62 engages a third reduction gear 64 which ultimately engages the globe portion 12 of the present invention and rotates said globe portion about the A—A axis. It is understood and contemplated by the present invention that the rotation means 28 as described herein may be comprised of any suitable means which would effectively rotate globe portion 12 of the present invention.

Referring now particularly to FIG. 6, an overall view of the globe portion 12 in association with the base portion 14 and the contents thereof is shown. The globe portion 12 comprises an upper spherical portion 66 and a lower collar 68. The collar 68 includes an aperture formed therein to allow passage of the hollow shaft 42. The collar 68 includes a second collar 70 having a diameter of less than that of the collar 68 and said second collar is in substantially abutting contact by inwardly extending circular members 72. A pin 74 is attached in a vertical position to the third reduction gear 64 and engages the second collar 70 and rotates the globe portion about the axis A—A. It is understood and contemplated by the present invention that the above-described rotating means and collar portions 68 may be comprised in any manner suitable to rotate globe portion 12 about an axis. It is additionally understood and contemplated by the present invention that the globe portion 12 may revolve about other axes or may include adjustable axes.

The light transmissive pegs 24, which includes a shank portion 26, wherein the shank portion is of such a diameter as to be able to pass such shank portion through the apertures of the globe portion 16. The diameter of the shank portion of the light transmissive peg 24 is configured so as to be a sufficient diameter to snugly fit within the apertures 16 thereby holding such light transmissive pegs in place even when the light transmissive pegs are inserted on an aperture formed in a sphere portion which face in a generally downward direction. The light transmissive pegs 24 do therefore not slide out of the apertures 16 by the force of gravity or the lower rpm resolution of the globe portion 12.

What is claimed is:

1. A three-dimensional construction toy and light apparatus comprising:

(a) a hollow member including a plurality of apertures formed substantially throughout a spherical surface of said member;

(b) an inner bladder disposed within said hollow member wherein said bladder is formed of an opaque flexible material including a plurality of cross slits formed therein in alignment with said apertures;

(c) a plurality of light transmissive pegs, each peg having a longitudinal axis, wherein each of said pegs includes a first and second end, said first end having an elongate shank having a diameter sized for insertion into a respective one of said apertures and of a length sufficient to penetrate said bladder; and said second end having an enlarged head portion of a diameter greater than said apertures, the intersection of the longitudinal axes of said pegs, when inserted into said apertures, defining a focus of said pegs; and (d) an internal light source disposed at the focus of said pegs so as to enhance light transmission therethrough;

(e) wherein insertion of said light transmissive pegs into said hollow member facilitates the formation of desired light emitting indicia upon said hollow member.

2. The three-dimensional construction toy and light apparatus of claim 1 further comprising a means of rotating said hollow member about an axis.

3. The three-dimensional construction toy and light apparatus of claim 2 wherein said axis of rotation passes through substantially the center point of said hollow member.

4. The three-dimensional construction toy and light apparatus of claim 2 wherein said axis of rotation is generally vertical.

5. The three-dimensional construction toy and light apparatus of claim 2 wherein said means for rotating said hollow member about an axis is powered by a battery device.

6. The three-dimensional construction toy and light apparatus of claim 2 wherein said means for rotating said hollow member about an axis is powered by an AC power supply.

7. The three-dimensional construction toy and light apparatus of claim 2 wherein said means for rotating said hollow member is enclosed within a lower housing wherein said lower housing forms a structural base for said hollow member.

8. The three-dimensional construction toy and light apparatus of claim 2 wherein said means for rotating said hollow member is controlled by a switch means.

9. The three-dimensional construction toy and light apparatus of claim 8 wherein said switch means controls the means for rotating said hollow member at variable speeds.

10. The three-dimensional construction toy and light apparatus of claim 1 wherein said internal light source is positioned at substantially the center point within said hollow member.

11. The three-dimensional construction toy and light apparatus of claim 1 wherein said internal light source is controlled by an on/off switch device.

12. The three-dimensional construction toy and light apparatus of claim 1 wherein said internal light source is controlled by a variable intensity light switch device.

13. The three-dimensional construction toy and light apparatus of claim 1 further comprising:

(a) a peg template comprising an apertured member configured to be disposed in laminar juxtaposition to the surface of said hollow member;

(b) wherein said apertured member includes a plurality of apertures formed therein; and (c) said plurality of apertures within said apertured member positioned to be substantially in alignment with the apertures formed in said hollow member and sized to receive the first end shank portion of one of said respective plurality of light transmissive pegs.

14. The three-dimensional construction toy and light apparatus of claim 1 wherein said light transmissive pegs, when inserted within said apertures and through said cross-slits, are configured to receive light from said internal light source and direct said light to the enlarged head portion of the second end of said light transmissive pegs.

* * * * *